United States Patent [19]

Hosoi et al.

[11] Patent Number: 4,721,700

[45] Date of Patent: Jan. 26, 1988

[54] HEAT-SENSITIVE RECORDING MATERIAL

[75] Inventors: Noriyuki Hosoi; Akihiro Shimomura; Yuichi Itabashi, all of Shizuoka, Japan

[73] Assignee: Fuji Photo Film Co., Ltd., Kanagawa, Japan

[21] Appl. No.: 899,353

[22] Filed: Aug. 22, 1986

[30] Foreign Application Priority Data

Aug. 22, 1985 [JP] Japan ..... 60-184484

[51] Int. Cl.[4] ..... B41M 5/18

[52] U.S. Cl. ..... 503/200; 427/152; 503/214; 503/226

[58] Field of Search ..... 346/200, 226; 427/150–152; 503/200, 208, 209, 214, 226

[56] References Cited

FOREIGN PATENT DOCUMENTS 188392 11/1982 Japan ..... 503/200

0245591 12/1985 Japan ..... 346/226

*Primary Examiner*—Bruce H. Hess

*Attorney, Agent, or Firm*—Sughrue, Mion, Zinn, Macpeak, and Seas

[57] ABSTRACT

A heat-sensitive recording material is disclosed, comprising a heat-sensitive layer containing a normally colorless or slightly colored dye precursor and a compound capable of reacting with the dye precursor to form color, with at least one of the heat-sensitive layer, an interlayer, and a protective layer containing polyvinyl alcohol as an adhesive and a hardener represented by formula (I)

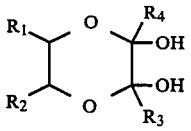

(I)

wherein $R_1$, $R_2$, $R_3$ and $R_4$ each represents a hydrogen atom, a halogen atom, a saturated or unsaturated hydrocarbon group containing from 1 to 6 carbon atoms, or a saturated or unsaturated hydrocarbon group containing from 1 to 20 carbon atoms and at least one ether bond.

9 Claims, No Drawings

HEAT-SENSITIVE RECORDING MATERIAL

FIELD OF THE INVENTION

This invention relates to a heat-sensitive recording material, and, more particularly, to a heat-sensitive recording material utilizing the coloration reaction between a normally colorless or slightly colored dye precursor and a compound capable of reacting with the dye precursor to form color (hereinafter referred to as a dye-developing compound).

BACKGROUND OF THE INVENTION

So-called two-component system heat-sensitive recording materials utilizing the coloration reaction between a colorless or slightly colored electron-donating dye precursor and an electron-accepting compound are disclosed, e.g., in Japanese Patent Publication Nos. 14039/70 (corresponding to U.S. Pat. No. 3,539,375 and British Pat. No. 1,135,540) and 4160/68, and Japanese Patent Application (OPI) No. 190886/84 (corresponding to U.S. Pat. No. 3,202,510) (the term "OPI" as used herein refers to a "published unexamined Japanese patent application").

Such two-component system heat-sensitive recording materials have the advantages that: (1) they utilize a primary coloration, and, therefore, do not require development; (2) they possess paper quality approximating that of ordinary paper; (3) they can be handled with ease; (4) they provide high density coloration; (5) heat-sensitive recording materials providing various coloration hues can be easily prepared; and the like, thus having great merits for use and being most popularly utilized as heat-sensitive recording materials.

Particularly in recent years, they have been remarkably utilized in the field of labels such as POS (point of sales) as well as in the fields of facsimile, recorders, and printers.

On the other hand, since these heat-sensitive recording materials utilize primary coloration, they have the defect that the reaction between a dye precursor and a color-developing compound can take place when they come into contact with a solvent or the like as well as when heat is applied thereto.

This is attributable to the fact that all of these heat-sensitive recording materials are made of organic substances and have therefore such a large solubility in a solvent that the reaction takes place in the solvent. Therefore, when in contact with a writing material such as an aqueous ink pen, an oily ink pen, a fluorescent ink pen, etc., a diazo developer, an adhesive or the like, white background of the heat-sensitive recording material can form color, or formed letters can disappear, and thus the commercial value of the material can be seriously spoiled.

In order to overcome this defect, it has been attempted, for example, to provide on a heat-sensitive color-forming layer a solvent resistant protective layer, as disclosed, e.g., in Japanese Patent Publication No. 27880/69 (corresponding to U.S. Pat. No. 3,445,216 and British Pat. No. 1,099,880), Japanese Patent Application (OPI) Nos. 30437/73, 31958/73, etc.

However, such techniques have the defects that resistance against various chemicals, oils, and water is still insufficient, that sensitivity is reduced, anti-sticking properties are insufficient, or blocking takes place, that production steps of such recording materials are complicated, and that such recording materials become costly, thus being industrially still unsatisfactory from an overall viewpoint.

In addition, Japanese Patent Application (OPI) No. 188392/82 describes a heat-sensitive recording material which has a protective layer containing a resin and a hardener. However, experiments of the inventors have revealed that the material shows still insufficient resistance when dipped in water.

Upon hardening of polyvinyl alcohol binder, widely known inorganic substances such as metal salts harden the binder so fast that they are industrially difficult to put into practice.

Further, it is difficult with hardeners as methylolmelamine, epoxy compounds, etc., to provide satisfactory water resistance, chemical resistance, and oil resistance.

SUMMARY OF THE INVENTION

An object of the present invention is to provide a heat-sensitive recording paper which enables printing letters with good density, which has sufficient resistance against various chemicals, oils, and water, sufficient anti-sticking properties, and sufficient anti-blocking properties, and which is industrially advantageous.

This object can be attained by a heat-sensitive recording material which has a heat-sensitive layer containing a normally colorless or slightly colored dye precursor and a compound capable of reacting with the dye precursor to form color, with at least one of the heat-sensitive layer, an interlayer, and protective layer containing polyvinyl alcohol as an adhesive and a hardener represented by formula (I)

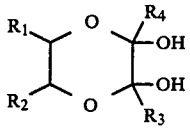

(I)

wherein $R_1$, $R_2$, $R_3$ and $R_4$ each represents a hydrogen atom, a halogen atom, a saturated or unsaturated hydrocarbon group containing from 1 to 6 carbon atoms, or a saturated or unsaturated hydrocarbon group containing from 1 to 20 carbon atoms and at least one ether bond.

DETAILED DESCRIPTION OF THE INVENTION

In the above formula (I), $R_1$, $R_2$, $R_3$ and $R_4$ each represents a hydrogen atom, a halogen atom, a saturated or unsaturated hydrocarbon group containing from 1 to 6 carbon atoms, or a saturated or unsaturated hydrocarbon group containing from 1 to 20 carbon atoms and at least one ether bond. The hydrocarbon groups represented by $R_1$ to $R_4$ in formula (I) may further have a substituent or substituents. Preferable examples of such substituents include a halogen atom, an alkoxy group, an aryloxy group, etc.

The hardener is preferably used in an amount of from 0.1 to 20 wt % of polyvinyl alcohol, more preferably from 0.5 to 5 wt %.

The heat-sensitive recording material in accordance with the present invention comprises a support having coated thereon at least one heat-sensitive layer, and may further have one or more interlayers and protective layers.

Colorless or slightly colored dye precursors that can be used in the heat-sensitive color-forming layer of the present invention include triarylmethane compounds, diphenylmethane compounds, xanthene compounds, thiazine compounds, spiropyran compounds, diazo compounds, etc. Specific examples thereof include those described in Japanese Patent Application (OPI) No. 27253/80 (corresponding to U.S. Pat. No. 4,283,458 and British Pat. No. 2,033,594), etc., and are partially exemplified below.

The triarylmethane compounds include 3,3-bis-(p-dimethylaminophenyl)-6-dimethylaminophthalide (or Crystal Violet lactone), 3,3-bis(p-dimethylaminophenyl)phthalide, 3-(p-dimethylaminophenyl)-3-(1,3-dimethylindol-3-yl)phthalide, 3-(p-dimethylaminophenyl)-3-(2-methylindol-3-yl)phthalide, etc., the diphenylmethane compounds include 4,4'-bisdimethylaminobenzhydrin benzyl ether, N-halophenylleucoauramine, N-2,4,5-trichlorophenylleucoauramine, etc., the xanthene compounds include Rhodamine B anilinolactam, Rhodamine (p-nitrilo)lactam, 2-(dibenzylamino)fluoran, 2-phenylamino-6-diethylaminofluoran, 2-(o-chloroanilino)-6-diethylaminofluoran, 2-(3,4-dichloroanilino)-6-diethylaminofluoran, 2-anilino-3-methyl-6-piperidinofluoran, 2-phenyl-6-diethylaminofluoran, etc., and the spiro compounds include 3-methylspiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)-spiropyran, 3-propyl-spiro-dibenzopyran, etc. These can be used alone or in combination.

The diazo compounds to be used in the present invention are diazonium salts represented by the formula of $ArN_2^+X^-$, which can undergo coupling reaction with a coupling component to form color, and which can be decomposed by light. In the formula, Ar represents a substituted or unsubstituted aromatic moiety, $N_2^+$ represents a diazonium group, and $X^-$ represents an acid anion.

Specific examples of the salt-forming diazo compounds include 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-toluylmercapto-2,5-diethoxybenzene, 4-diazo-1,4-methoxybenzoylamino-2,5-diethoxybenzene, etc.

Specific examples of the acid anion $X^-$ include $C_nF_{2n+1}COO^-$ (wherein n represents an integer of from 3 to 9), $C_mF_{2m+1}SO_3^-$ (wherein m represents an integer of from 2 to 8), $(ClF_{2l+1}SO_2)_2CH^-$ (wherein l represents an integer of from 1 to 18),

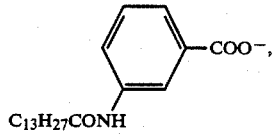

-continued

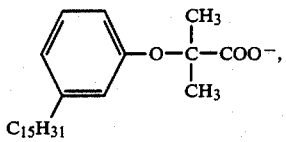

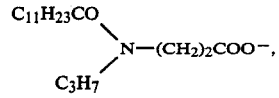

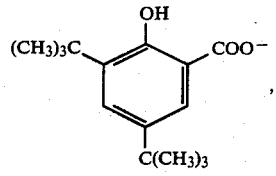

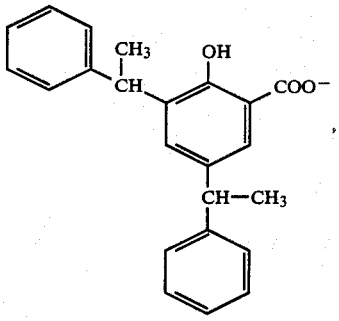

$BF_4^-$, $PF_6^-$.

As the color-developing compounds to be used in the heat-sensitive color-forming layer of the present invention, preferred are those which are represented by the following formulae (II) to (VI)

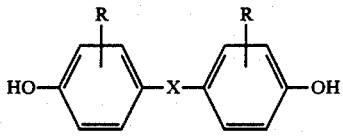

(II)

wherein X represents S, O, $SO_2$, $S_2$ or

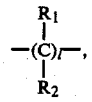

l represents an integer of from 0 to 3, $R_1$ and $R_2$ each represents a hydrogen atom, an alkyl group containing from 1 to 8 carbon atoms, or $R_1$ and $R_2$ together represent a cycloalkyl group, and R represents a straight or branched alkyl group containing from 1 to 8 carbon atoms or a halogen atom;

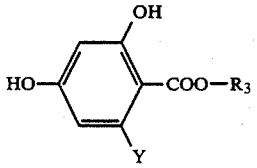

(III)

wherein Y represents a hydrogen atom, —$CH_3$ or —OH, $R_3$ represents

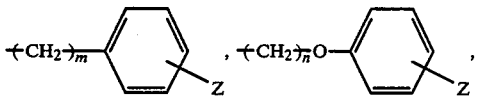

a straight or branched alkyl group containing from 1 to 6 carbon atoms, m and n each represents an integer of from 0 to 3, Z represents a hydrogen atom, a halogen atom or —$CH_3$;

(IV)

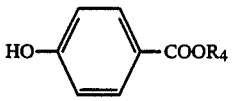

wherein $R_4$ represents a benzyl group, a benzyl group substituted by a halogen atom or a straight or branched alkyl group containing from 1 to 8 carbon atoms, or a straight or branched alkyl group containing from 1 to 8 carbon atoms;

(V)

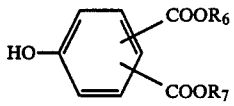

wherein $R_6$ and $R_7$ each represents an alkyl group containing from 1 to 8 carbon atoms; and (VI)

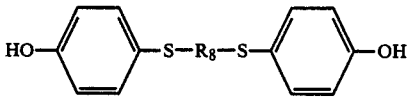

wherein $R_8$ represents an alkylene group containing from 1 to 5 ether bonds.

Preferable examples in addition to the electron-accepting compounds represented by the above formulae (II) to (VI) are bishydroxycumylbenzenes or bishydroxyα-methylbenzylbenzenes. Specific examples thereof include 1,4-bis-p-hydroxycumylbenzene, 1,4-bis-m-hydroxycumylbenzene, 1,3-bis-p-hydroxycumylbenzene, 1,3-bis-m-hydroxycumylbenzene, 1,4-bis-o-hydroxycumylbenzene, 1,4-bis-p-hydroxy-α-methylbenzylbenzene, 1,3-bis-p-hydroxy-α-methylbenzylbenzene, etc. Salicylic acid derivatives are exemplified by such salicylic acids as 3,5-di-α-methylbenzylsalicylic acid, 3,5-di-tertiary-butylsalicylic acid, 3-α,α-dimethylbenzylsalicylic acid, etc., and polyvalent metal salts thereof (particularly preferable metals being zinc and aluminum). Particularly preferred are phenols such as p-phenylphenol, 3,5-diphenylphenol, cumylphenol, etc. However, these compounds are not limitative at all.

The above-described color-developing compounds are preferably used in an amount of from 50 to 1,000 wt % of the dye precursor, and more preferably from 100 to 500 wt %. They may be used alone or in combinations of two or more.

Where the dye precursor is a diazo compound, those which couple with the diazo compound (diazonium salt) in a basic environment to form dye are used as a coupling component. Specific examples of such coupling component include resorcin, phloroglucin, sodium 2,3-dihydroxynaphthalene-6-sulfonate, 1-hydroxy-2-naphthoic acid morpholinopropylamide, 1,5-dihydroxynaphthalene, 2,3-dihydroxynaphthalene, 2,3-dihydroxy-6-sulfanylnaphthalene, 2-hydroxy-3-naphthoic acid morpholinopropylamide, 2-hydroxy-3-naphthoic acid anilide, 2-hydroxy-3-naphthoic acid 2'-methylanilide, 2-hydroxy-3-naphthoic acid ethanolamide, 2-hydroxy-3-naphthoic acid octylamide, 2-hydroxy-3-naphthoic acid N-dodecyloxypropylamide, 2-hydroxy-3-naphthoic acid tetradecylamide, acetanilide, acetacetanilide, benzoyl acetanilide, 1-phenyl-3-methyl-5-pyrazolone, 1-(2',4',6'-trichlorophenyl)-3-benzamido-5-pyrazolone, 1-(2',4',6'-trichlorophenyl)-3-anilino-5-pyrazolone, 1-phenyl-3-phenylacetamido-5-pyrazolone, etc. An image with an optional color tone can be formed by employing two or more of these coupling components.

As a coloration aid to be used in the present invention, slightly water-soluble or water-insoluble basic substances and those substances which produce alkali by heating can be used.

Useful coloration aids include inorganic and organic ammonium salts and N-containing compounds such as organic amines, amides, urea, thiourea, derivatives thereof, thiazoles, pyrroles, pyrimidines, piperazines, guanidines, indoles, imidazoles, imidazolines, triazoles, morpholines, piperidines, amidines, formamidines, pyridines, etc.

In the heat-sensitive recording material of the present invention, a heat-meltable substance may be incorporated in the heat-sensitive color-forming layer for improving heat responsiveness.

Specific examples thereof include benzyl p-benzyloxybenzoate, β-naphthyl benzyl ether, stearic acid amide, palmitic acid amide, N-phenylstearic acid amide, N-stearylurea, β-naphthoic acid phenyl ester, 1-hydroxy2-naphthoic acid phenyl ester, β-naphthol (p-chlorobenzyl) ether, β-naphthol (p-methylbenzyl) ether, α-naphthyl benzyl ether, 1,4-butanediol p-methylphenyl ether, 1,4-propanediol p-methylphenyl ether, 1,4-butanediol p-isopropylphenyl ether, 1,4-butanediol p-t-octylphenyl ether, 2-phenoxy-1-p-tolyl-oxy-ethane, 1-phenoxy-2-(4-ethylphenoxy)ethane, 1-phenoxy-2-(4-chlorophenoxy)ethane, 1,4-butanediol phenyl ether, etc.

The above-described heat-meltable substances may be used alone or in combination, and, in order to obtain enough heat responsiveness, they are preferably used in an amount of from 10 to 20 wt %, and more preferably from 20 to 150 wt %, based on the weight of the electron-accepting compound.

In a two-component type heat-sensitive recording material using an electron-donating dye precursor and an electron-accepting compound, a resulting recorded image generally tends to disappear due to the influence of ambient conditions such as humidity and heat.

In the heat-sensitive recording material of the present invention, compounds which prevent disappearance of formed color may be incorporated in the heat-sensitive color-forming layer of the recording material for preventing color disappearance and for making formed images fast.

As such color disappearance-preventing agents, phenol derivatives, and particularly hindered phenol compounds, are effective.

The phenol compounds are preferably used in an amount of from 1 to 200 wt %, and more preferably from 5 to 50 wt %, based on the weight of the electron-accepting compound.

The polyvinyl alcohols to be used in the present invention as an adhesive are not particularly limited, and ordinary polyvinyl alcohols and modified polyvinyl alcohols can be used. In the case of using ordinary polyvinyl alcohols, those which have a saponification degree of 86% or more and a polymerization degree of 1,000 or more are preferable.

Useful modified polyvinyl alcohols include carboxy-modified polyvinyl alcohols, silica-modified polyvinyl alcohols, etc. In the case of using silicamodified polyvinyl alcohols, colloidal silica is preferably used together. In addition, there may be used together water-soluble high polymers such as methyl cellulose, carboxymethyl cellulose, hydroxymethyl cellulose, starches, gelatin, gum arabic, casein, styrene-maleic anhydride copolymer hydrolyzate, styrenemaleic anhydride half ester hydrolyzate, isobutylenemaleic anhydride copolymer hydrolyzate, polyacrylamide derivatives, polyvinyl pyrrolidone, sodium polystyrenesulfonate, sodium alginate, etc., and water-insoluble polymers such as styrene-butadiene rubber latex, acrylonitrile-butadiene rubber latex, methyl acrylatebutadiene rubber latex, vinyl acetate emulsion, etc.

The polyvinyl alcohols are preferably used in an amount of from 0.5 to 8 g/m$^2$, more preferably from 1 to 4 g/m$^2$, in the heat-sensitive layer, preferably from 0.1 to 2 g/m$^2$, more preferably from 0.2 to 1 g/m$^2$, in the interlayer, and preferably from 0.2 to 4 g/m$^2$, more preferably from 0.4 to 2 g/m$^2$, in the protective layer.

To the heat-sensitive color-forming layer of the present invention may be added, if desired, a pigment, a metallic soap, a wax, a surfactant, etc.

As the pigment, zinc oxide, calcium carbonate, barium sulfonate, titanium oxide, lithopone, talc, agalmatolite, kaolin, aluminum hydroxide, silica, amorphous silica, etc., can be used.

As the metallic soap, metal salts of higher fatty acids are used. For example, emulsions of zinc stearate, calcium stearate, aluminum stearate, etc., can be used.

As the wax, emulsions of paraffin wax, microcrystalline wax, carnauba wax, methylolstearoamide, polyethylene wax, polystyrene wax, etc., can be used.

As the surfactant, alkali metal salts of sulfosuccinic acid, fluorine-containing surfactants, etc., can be used.

The heat-sensitive color-forming layer of the present invention is coated preferably in an amount of from 1 to 10 g/m$^2$.

In the present invention, a pigment, a metallic soap, a wax, etc., may be added to the protective layer for the purpose of improving matching properties with a thermal head upon printing, water resistance of the protective layer, etc.

The pigment is added preferably in an amount of from 0.5 to 4 times, and particularly preferably from 0.8 to 3.5 times, as much as the total amount of the polymer. If the amount is less than the above described lower limit, the pigment is ineffective in improving head-matching properties, whereas if more than the upper limit, it seriously reduces sensitivity, thus damaging commercial value of the material. As the pigment, zinc oxide, calcium carbonate, barium sulfate, titanium oxide, lithopone, talc, agalmatolite, kaolin, aluminum hydroxide, silica, amorphous silica, colloidal silica, etc., can be used.

As the metallic soap, metal salts of higher fatty acids are used. For example, zinc stearate, calcium stearate, aluminum stearate, etc., are used as emulsions, with zinc stearate being particularly preferable. The soap is preferably added in an amount of from 0.5 to 20%, and particularly preferably from 1 to 10%, of the total weight of the protective layer.

As the wax, emulsions of paraffin wax, microcrystalline wax, carnauba wax, methylolstearoamide, stearic acid amide, polyethylene wax, polystyrene wax, etc., can be used, in an amount of from 1 to 20%, and particularly preferably from 1 to 10%, based on the total weight of the protective layer.

Upon coating the protective layer on the heat-sensitive color-forming layer, a surfactant may be added thereto in order to obtain a uniform protective layer. As the surfactant, alkali metal salts of sulfosuccinic acid, fluorine-containing surfactants, etc., can be used. Specific examples thereof include sodium or ammonium salts of di(2-ethylhexyl)sulfosuccinate, di(n-hexyl)sulfosuccinate, etc. However, almost all anionic surfactants are effective.

The protective layer is coated preferably in an amount of from 0.5 to 10 g/m$^2$, and particularly preferably from 1 to 5 g/m$^2$.

The protective layer may have a structure of a plurality of layers of different components. In addition, an undercoating layer containing an adhesive and a back coating layer may also be provided.

The present invention is now illustrated in greater detail by reference to the following examples, which, however, are not to be construed as limiting the present invention in any way. Percent values therein are by weight, unless otherwise indicated.

EXAMPLE 1

20 g of Crystal Violet lactone, 20 g of benzyl p-hydroxybenzoate, stearic acid amide, and 20 g of 1,1,3-tris (2-methyl-4-hydroxy-5-tert-butylphenyl)butane were respectively subjected to a ball mill for about 24 hours together with 100 g of a 5% polyvinyl alcohol (Kuraray PVA 105) aqueous solution to reduce the volume average particle size to 3 μm or less. 80 g of calcium carbonate (Unibur; made by Shiraishi Kogyo Co., Ltd.) was subjected to a homogenizer together with 160 g of a 0.5% solution of sodium hexametaphosphate to form a dispersion. 5 g of the thus prepared dispersion of Crystal Violet lactone, 10 g of the dispersion of benzyl p-hydroxybenzoate, 5 g of the dispersion of stearic acid amide, 2 g of the dispersion of 1,1,3-tris(2-methyl-4-hydroxy-5-tert-butylphenyl)butane, and 22 g of the dispersion of calcium carbonate were mixed, and, further, 3 g of a 21% suspension of zinc stearate, 10 g of 4% 2,3-dihydroxy-5-methyl-1,4-dioxane, and 5 g of a 2% aqueous solution of sodium di(2-ethylhexyl)sulfosuccinate were blended into the mixture. The resulting coating solution was coated in a dry weight of 5 g/m$^2$ on a wood free paper of 60 g/m$^2$ basis weight using a wire bar, then dried in a 50° C. oven to obtain a heat-sensitive color-forming layer.

On the thus obtained heat-sensitive color-forming layer was coated a coating solution obtained by mixing 0.4 g of 2,3-dihydroxy-5-methyl-1,4-dioxane, 15 g of a dispersion of kaolin (Kaobrite; made by Georgia Pacific Co.) (dispersion being prepared in the same manner as the dispersion of calcium carbonate in Example 1), 4 g of a 21% emulsion of zinc stearate, and 1 g of a 2% aqueous solution of sodium di(2-ethylhexyl)sulfosuccinate, in a dry weight of 3 g/m$^2$ using a wire bar, then dried in a 50° C. oven to obtain heat-sensitive recording paper.

EXAMPLE 2

A heat-sensitive recording paper was obtained in the same manner as in Example 1 except for using 2,3-dihydroxy-5-chloromethyl-1,4-dioxane in place of 2,3-dihydroxy-5-methyl-1,4-dioxane.

EXAMPLE 3

A heat-sensitive recording paper was obtained in the same manner as in Example 1 except for using 2,3-dihydroxy-5-methyl-6-ethyl-1,4-dioxane in place of 2,3-dihydroxy-5-methyl-1,4-dioxane.

EXAMPLE 4

A heat-sensitive recording paper was obtained in the same manner as in Example 1 except for using 2,3-dihydroxy-2-methyl-1,4-dioxane in place of 2,3-dihydroxy-5-methyl-1,4-dioxane.

EXAMPLE 5

A heat-sensitive recording paper was obtained in the same manner as in Example 1 except for using 2,3-dihydroxy-2-methyl-5-diethylether-1,4-dioxane in place of 2,3-dihydroxy-5-methyl-1,4-dioxane.

COMPARATIVE EXAMPLE 1

An attempt was made to prepare a heat-sensitive recording paper in the same manner as in Example 1 except for using a 5% aqueous solution of chromium alum in place of 2,3-dihydroxy-5-methyl-1,4-dioxane, but coagulation of the coating solution took place upon mixing with chromium alum, the solution thus being unable to be coated.

COMPARATIVE EXAMPLE 2

A heat-sensitive recording paper was obtained in the same manner as in Example 1 except for using methylolmelamine (Sumirez Resin 607; made by Sumitomo Chemical Co., Ltd.) in place of 2,3-dihydroxy-5-methyl-1,4-dioxane, in the same amount.

COMPARATIVE EXAMPLE 3

A heat-sensitive recording paper was obtained in the same manner as in Example 1 except for using an epoxy compound (Denacole EX-820; Nagase Sangyo Co., Ltd.) in place of 2,3-dihydroxy-5-methyl-1,4-dioxane, in the same amount.

The heat-sensitive recording papers obtained in Examples 1 to 5 and Comparative Examples 2 and 3 were subjected to a label printer, TEC-H 9606 (made by Tokyo Electric Co., Ltd.) in an atmosphere of 23° C. and 65% RH to form color for examining anti-sticking properties, anti-blocking properties, resistance against water, oil and chemicals.

Printing 10,000 sheets of paper, there observed no problems as to anti-sticking properties and anti-blocking properties.

As is shown in Table 1, water resistance, oil resistance, and chemical resistance are improved by using the hardeners in accordance with the present invention.

TABLE 1

Evaluation of Water Resistance, Oil Resistance, and Chemical Resistance:

| | Example | | | | | Comparative Example | | |
|---|---|---|---|---|---|---|---|---|
| | 1 | 2 | 3 | 4 | 5 | 1 | 2 | 3 |
| Water resistance 1(*1) | A | A | A | A | A | — | B | C |
| Water resistance 2(*2) | A | A | A | A | A | — | C | C |
| Ethanol resistance(*3) | A | A | A | A | A | — | B | B |
| Cooking oil resistance | B | B | B | B | B | — | C | C |

TABLE 1-continued

Evaluation of Water Resistance, Oil Resistance, and Chemical Resistance:

| | Example | | | | | Comparative Example | | |
|---|---|---|---|---|---|---|---|---|
| | 1 | 2 | 3 | 4 | 5 | 1 | 2 | 3 |
| (rape oil)(*3) | | | | | | | | |
| Fat resistance (cow)(*3) | B | A | B | A | B | — | A | C |
| Dibutyl phthalate resistance(*3) | B | B | A | A | B | — | C | C |

(*1)Samples were rubber 20 reciprocating times by a water-wetted swab.
(*2)Samples were evaluated after dipping for 16 hours in water.
(*3)Samples were evaluated 24 hours after applying thereto the indicated chemical by using a swab.
A: Letters were not changed at all.
B: Letters were blurred, but still practicably usable.
C: Samples were unable to be practicably used due to blurring or disappearance of letters.

While the invention has been described in detail and with reference to specific embodiments thereof, it will be apparent to one skilled in the art that various changes and modifications can be made therein without departing from the spirit and scope thereof.

What is claimed is:

1. A heat sensitive recording material comprising at least one heat sensitive layer containing a normally colorless or slightly colored dye precursor and a compound capable of reacting with the dye precursor to form color, interlayer and protective layer, with at least one heat sensitive layer, wherein said interlayer is interposed between the heat sensitive layer and the protective layer and wherein at least one of the heat sensitive layer, an interlayer, and a protective layer contains polyvinyl alcohol as an adhesive and a hardener represented by formula (I)

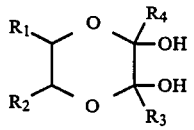

(I)

wherein $R_1$, $R_2$, $R_3$ and $R_4$ each represents a hydrogen atom, a halogen atom, a saturated or unsaturated hydrocarbon group containing from 1 to 6 carbon atoms, or a saturated or unsaturated hydrocarbon group containing from 1 to 20 carbon atoms and at least one ether bond.

2. A heat-sensitive recording material as in claim 1, wherein said polyvinyl alcohol and said hardener represented by formula (I) are present in the heat-sensitive layer.

3. A heat-sensitive recording material as in claim 2, wherein said hardener represented by formula (I) is present in the heat-sensitive layer in an amount of from 0.1 to 20 wt % of polyvinyl alcohol.

4. A heat-sensitive recording material as in claim 1, wherein said polyvinyl alcohol and said hardener represented by formula (I) are present in an interlayer.

5. A heat-sensitive recording material as in claim 1, wherein said polyvinyl alcohol and said hardener represented by formula (I) are present in a protective layer.

6. A heat-sensitive recording material as in claim 5, wherein said hardener represented by formula (I) is present in the protective layer in an amount of from 0.1 to 20 wt % of polyvinyl alcohol.

7. A heat-sensitive recording material as in claim 5, wherein said hardener represented by formula (I) is present in the protective layer in an amount of from 0.5 to 5 wt % of polyvinyl alcohol.

8. A heat-sensitive recording material as in claim 1, wherein said hardener represented by formula (I) is present in a layer containing polyvinyl alcohol as an adhesive in an amount of from 0.1 to 20 wt % of polyvinyl alcohol.

9. A heat-sensitive recording material as in claim 1, wherein said hardener represented by formula (I) is present in the heat-sensitive layer in an amount of from 0.5 to 5 wt % of polyvinyl alcohol.

* * * * *